US008336800B1

(12) United States Patent
Lopez

(10) Patent No.: US 8,336,800 B1
(45) Date of Patent: Dec. 25, 2012

(54) POWERED HOSE REEL DEVICE

(76) Inventor: John D. Lopez, Apollo Beach, FL (US)

( * ) Notice: Subject to any disclaimer, the term of this patent is extended or adjusted under 35 U.S.C. 154(b) by 249 days.

(21) Appl. No.: 12/690,390

(22) Filed: Jan. 20, 2010

(51) Int. Cl.
*B65H 75/48* (2006.01)

(52) U.S. Cl. ..... 242/390.8; 242/406; 137/355.2; 137/355.27

(58) Field of Classification Search ..... 242/390.8, 242/390.9, 394.1, 395, 395.1, 406; 137/355.12, 137/355.2, 355.26, 355.27
See application file for complete search history.

(56) References Cited

U.S. PATENT DOCUMENTS

| | | | | |
|---|---|---|---|---|
| 2,573,868 | A * | 11/1951 | Newell | 137/355.21 |
| 4,445,643 | A | 5/1984 | Thorsby et al. | |
| 4,513,772 | A | 4/1985 | Fisher | |
| 4,832,074 | A | 5/1989 | Li | |
| 4,993,449 | A * | 2/1991 | Stutzman et al. | 137/355.26 |
| 5,495,995 | A | 3/1996 | Dominique | |
| 6,474,588 | B2 | 11/2002 | Valverde | |
| 6,802,336 | B1 * | 10/2004 | Holmquist | 137/355.2 |
| 6,877,687 | B2 | 4/2005 | Moon et al. | |
| 7,044,421 | B1 * | 5/2006 | Omdoll et al. | 242/564.4 |
| 7,316,368 | B2 | 1/2008 | Moon et al. | |
| 7,503,338 | B2 * | 3/2009 | Harrington et al. | 137/355.2 |
| 7,931,225 | B2 * | 4/2011 | Wang | 242/390 |
| 2008/0295894 | A1 * | 12/2008 | Uffner et al. | 242/390.5 |

* cited by examiner

*Primary Examiner* — William A Rivera
(74) *Attorney, Agent, or Firm* — Thomas Frost

(57) ABSTRACT

The present invention relates to a powered hose reel device for taking up a hose about a reel without having to do so by hand. A reel is disposed between the reel support walls and mounted on one end to a rim integrally formed on an inner wall of one of the reel support walls. The reel is adapted to carry a hose thereabout. There is a motor mounted to one of the reel support portions, and disposed within the chamber formed by the inner wall of the reel. A rechargeable battery provides power. A shaft is operatively connected to the motor and is engaged with a bracket mounted to the inner surface of the reel. When the motor is activated the shaft turns the reel. A hose guide assembly is provided for leading and guiding the hose during the retrieving of the hose about the reel. A solar panel recharges the battery when the device is not operating.

6 Claims, 6 Drawing Sheets

POWERED HOSE REEL DEVICE

BACKGROUND OF INVENTION

The present invention relates to an automated reel for hoses and more particularly pertains to a motor driven hose reel device powered by a rechargeable battery, and being recharged by a solar panel.

The use of reels for hoses, either powered by a manual crank or driven by a direct current powered motor, is known in the prior art. A number of automated hose retrieval devices have been developed to automatically retrieve and rewind hose, some including motors being driven by a rechargeable battery. Such devices have included the use of remote activation mechanisms, such as radio remote control systems.

However, the motorized devices in the prior art utilize a drive pulley in conjunction with the direct current powered motor to provide rotational movement of the reel. The present invention utilizes a shaft connected to a bracket powered by a motor positioned within the interior of the reel to provide movement of the reel. The invention does not require belts or pulleys to rewind the hose. The present invention is also adapted to be mounted to a wall structure.

Additionally, the battery providing power in the present invention is recharged by a solar panel. There is an increasing need for "green technology." The present invention utilizes significantly less energy than prior motor driven hose reels, and avoids the need to be connected to the electrical grid because the battery will be recharged when the motor is not in use.

SUMMARY OF THE INVENTION

The general purpose of the present invention, which will be described subsequently in greater detail, is to provide a new and improved powered hose reel device.

To attain this, the present invention comprises a frame and reel support panels. The frame is adapted to mount to a wall structure.

A reel is disposed between the reel support panels and mounted on one end to a rim integrally formed on an inner wall of one of the reel support panels. The reel is adapted to carry a hose thereabout. There is a motor mounted to one of the reel support panels, and disposed within the chamber formed by an inner surface of the reel. A shaft is operatively connected to the motor and is engaged with a bracket mounted to the inner surface of the reel. When the motor is activated the shaft turns the reel.

A hose guide assembly is disposed between the reel support panels for leading and guiding the hose during the retrieving of the hose about the reel.

A solar panel is conventionally connected to the battery and provides recharging of the battery when the device is not in use.

It is an object of the invention to provide a motor positioned within the interior of the reel to provide movement of the reel and rewinding of hose without requiring belts or pulleys connected to a direct current motor.

It is a further object of the invention to provide a solar panel to recharge the battery powering the motor when the device is not in use.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
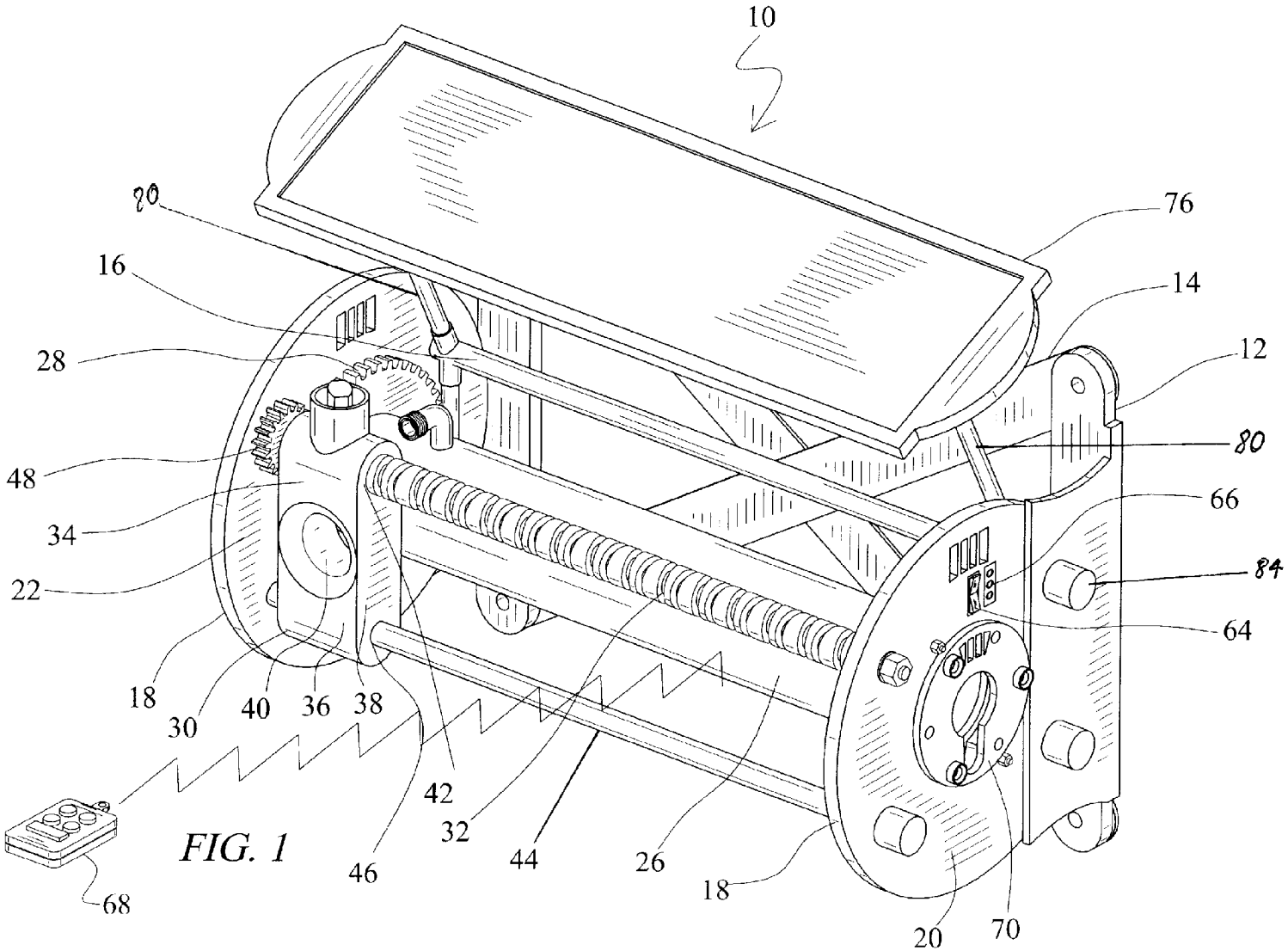
FIG. 1 is a perspective view of a new powered hose reel device according to the present invention.
Figure 2:
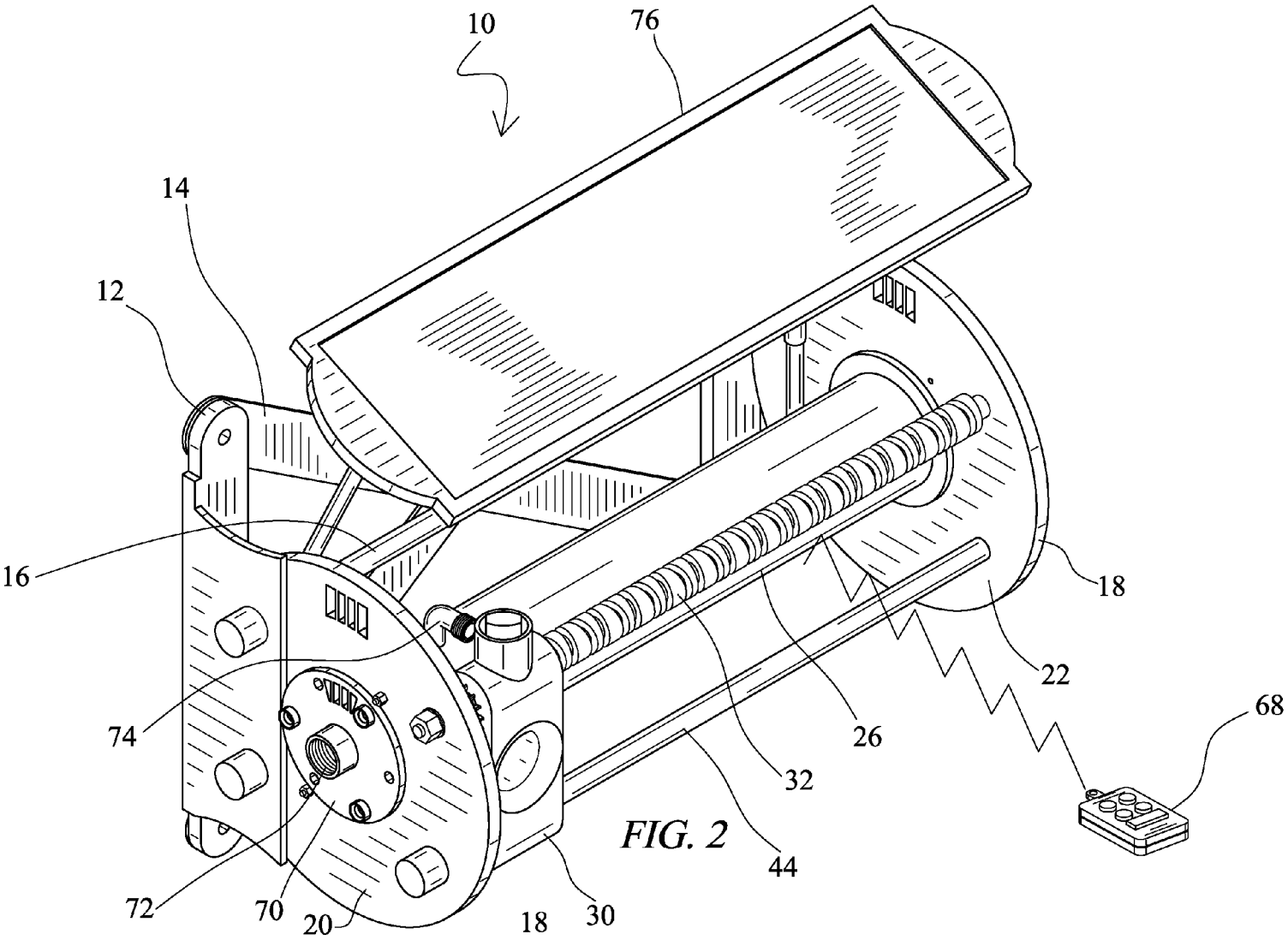
FIG. 2 is a second perspective view of the present invention.
Figure 3:
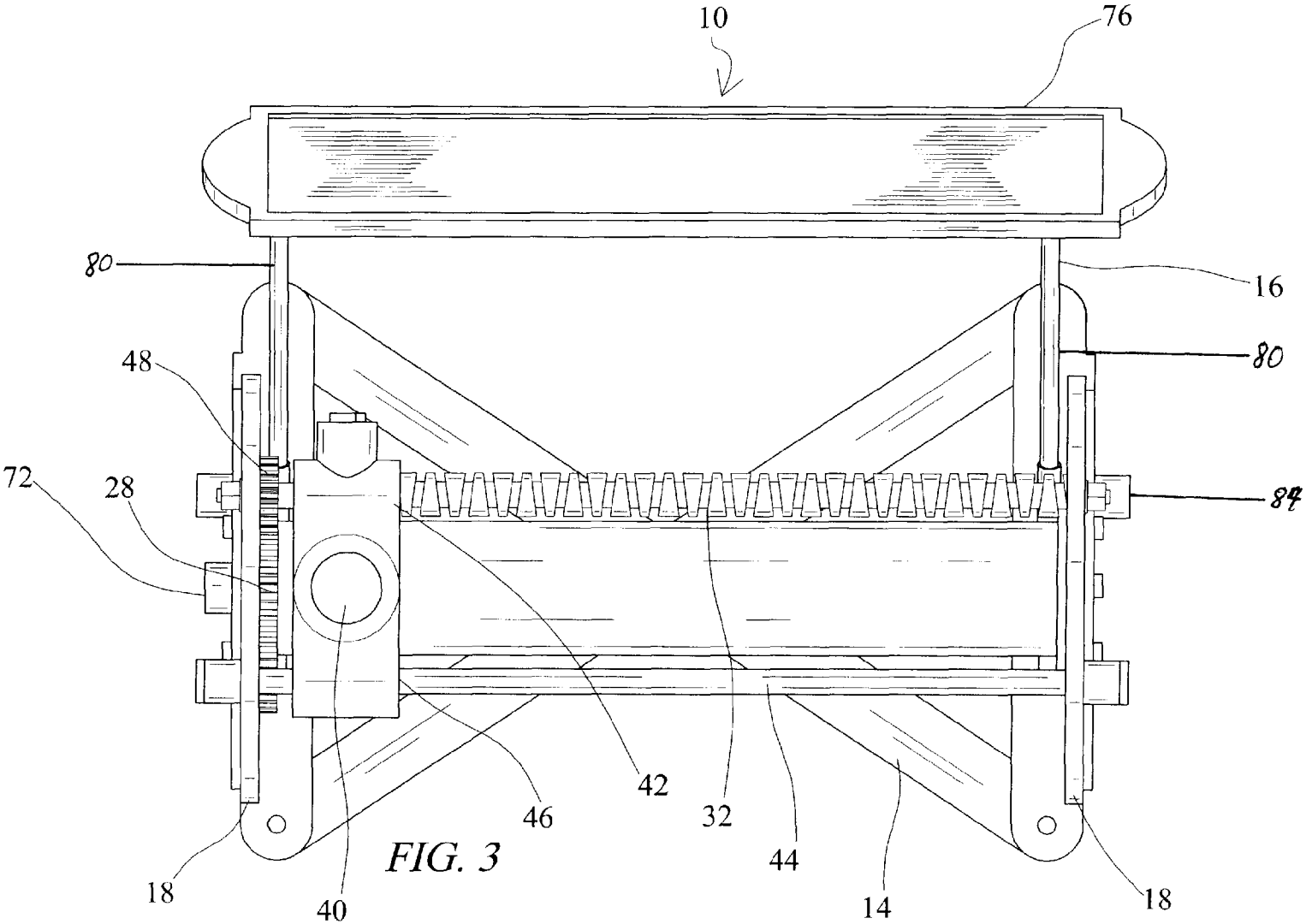
FIG. 3 is a front view of the present invention.

With reference now to the drawings, and in particular first to FIGS. 1 through 4 thereof, therein is shown at 10 a preferred embodiment of the present invention of a powered hose reel device. The device 10 has a frame 12 with a back section 14 and a support section 16. The frame 12 is adapted to be mounted to a wall structure of a building. Reel support panels 18 are spaced apart and depend from the frame 12. Each of the reel support panels 18 includes an outer surface 20 and an inner surface 22 which is closely spaced from and disposed generally parallel to the outer surface 20. The reel support panels 18 have an opening therethrough. A rim 24 is integrally formed with, and disposed on, the inner surface 22 of one of the reel support panels 18.

The support section 16 has a pair of poles 80 and a bar 82, each pole having a first end and a second end, and each pole being mounted to the bar 82 at the second ends. The bar 82 is outwardly threaded at one end, and is secured to one of the rear support panels 18 by an inwardly threaded cap 84. The bar 82 is oriented perpendicular to the poles 80. The poles 80 are oriented parallel to each other and depend upwardly. The poles 80 are mounted juxtaposed opposed ends of the bar 82.

A reel 26 has an inner surface and an outer surface, a first end and a second end, and has an open chamber defined longitudinally along the inner surface. The reel 26 is adapted to carry a hose thereabout, and is rotatably disposed on the rim 24 at the first end. A reel gear 28 is integrally formed on the outer surface of the reel 26 juxtaposed the second end of the reel 26.

A hose leader/guide assembly 30 is disposed between the reel support panels 18 for leading and guiding the hose during the taking up of the hose about the reel 26. The hose leader/guide assembly 30 includes a threaded rod 32 having a first end and a second end, with an outer surface, the ends being disposed through the reel support panels 18. A support rod 44 having a first end and a second end is located below the threaded rod 32, with the ends of the support rod 44 being disposed through the reel support panels 18. The hose leader/guide assembly 30 also includes a guide member 34 movably mounted about the threaded rod 32 and the support rod 44, and being movable therealong. The guide member 34 has front, back and side walls 36, 38, and also a first bore 40 being disposed through the front and back walls 36, a second bore 42 through which the threaded rod 32 is extended, and further a third bore 46 through which the support rod 44 is extended. An assembly gear 48 is integrally formed on the outer surface of the threaded rod 32 at the second end and positioned between the guide member 34 and the reel support panel 18.

Figure 4:
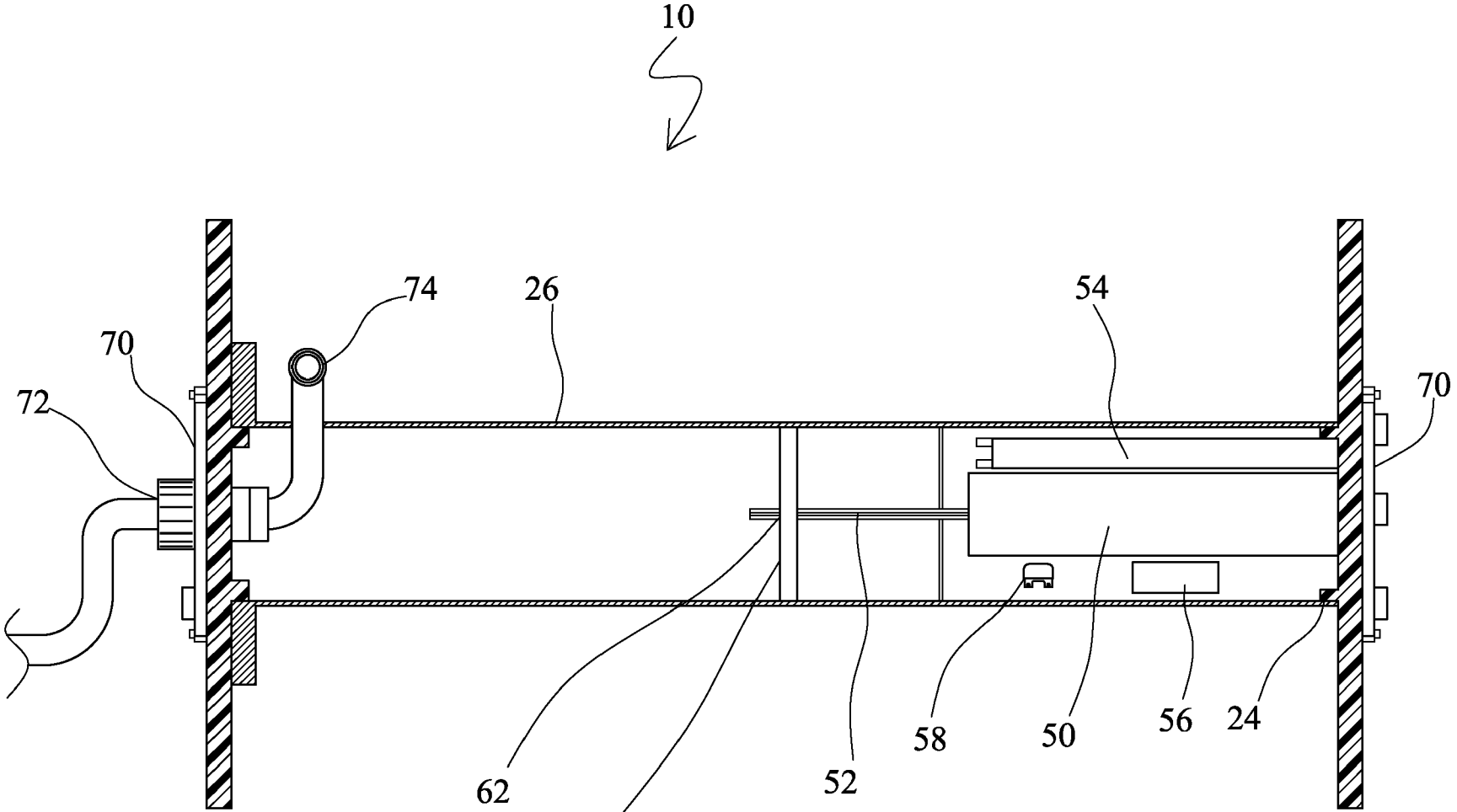
FIG. 4 is a front cross-sectional view of the present invention illustrating the means to actuate the reel.
Figure 5:
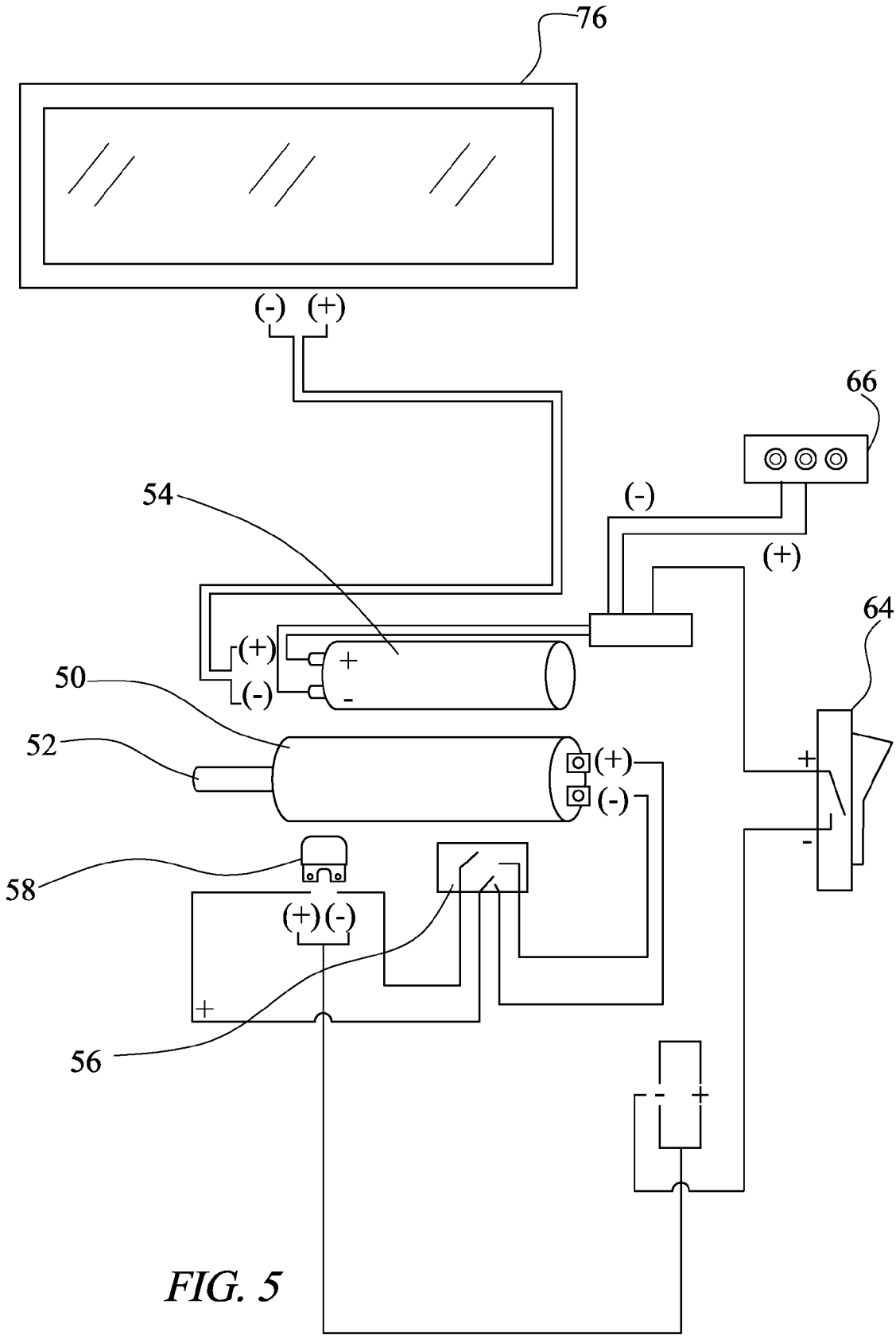
FIG. 5 is a schematic diagram illustrating control of the motor.

A means of actuating the taking up of the hose about the reel 26 is illustrated in FIG. 4. A motor 50 is conventionally mounted to the inner surface 22 of the reel support panel 18.

Alternatively the motor is connected to a plate 70 which is mounted to the reel support panel 18. The means of actuating further includes a rotatable motor shaft 52 having a first end and a second end, the first end being operatively connected to the motor 50, and further includes a bracket 60 having a first end and a second end being mounted through the inner surface of the reel 26. The bracket 60 has an aperture configured to engage with the second end of the motor shaft 52.

Figure 6:
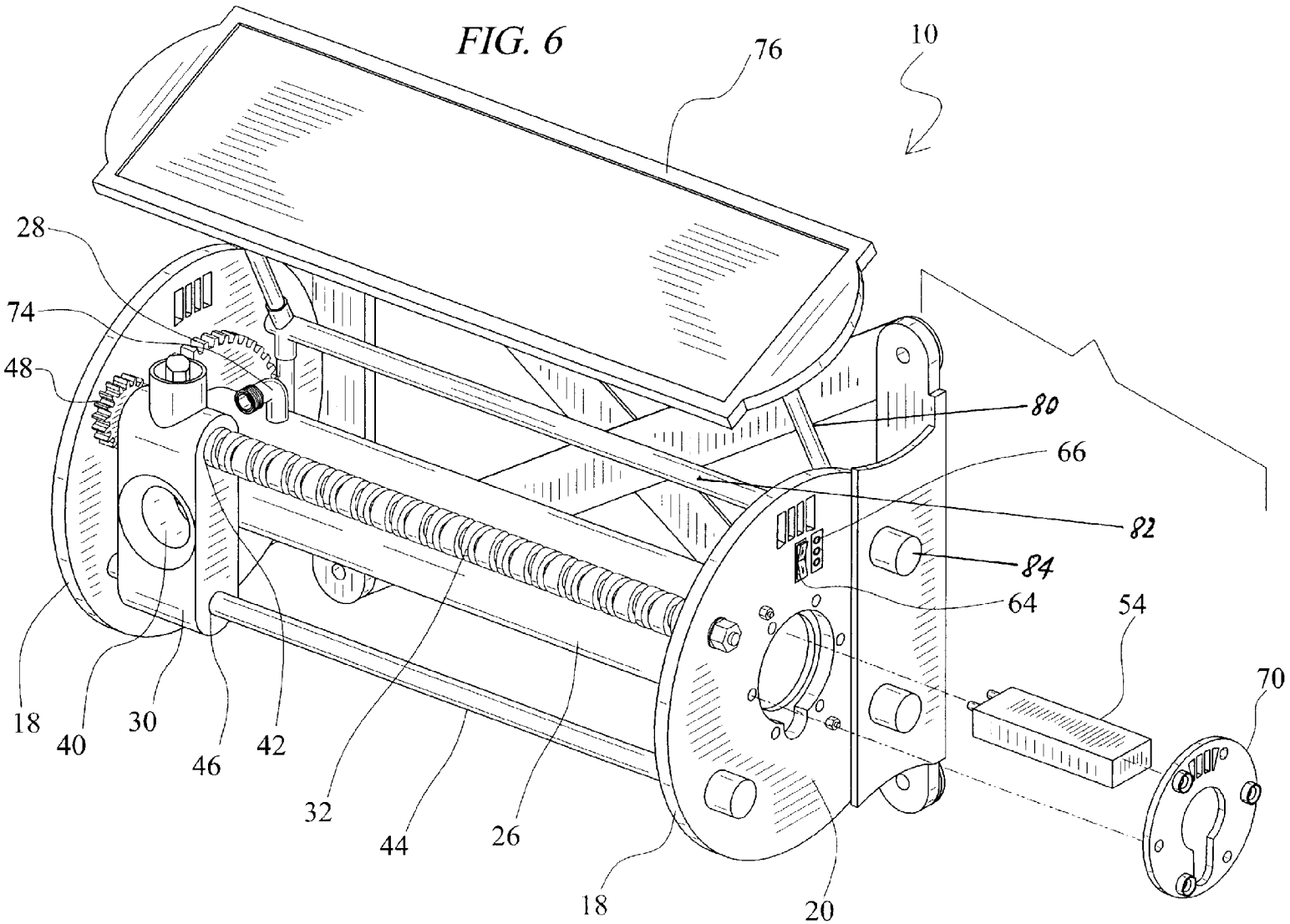
FIG. 6 is a partial exploded view illustrating the removal of the battery.

A battery 54 is a power source mounted within the reel 26 for energizing the motor 50, and is connected with wires to the motor 50. The battery 54 is maintenance free and rechargeable, and will preferably be 12 volts. The battery 54 is disposed relatively near the motor 50 within the chamber of the reel 26, and as illustrated in FIG. 6 in the preferred embodiment, is removable for replacement by removing the plate 70. An amp breaker 58 is disposed inline between the motor 50 and the battery 54.

A solar panel and solar cell 76 is mounted on the first end of the poles 80 of the support section 16 of the frame 12. The structure of suitable solar panels and cells are well known in the prior art and will not be described in detail here. The preferred solar panel and cell is 2.25 wattage rated and powered at 15 volts operating voltage. The solar panel and cell 76 is in electronic communication with wires to the battery 54. During times of non-use of the device the solar panel and cell 76 recharge the battery 54. A battery status display 66 mounted on one of the reel support panels 18 is included to provide an LED (light emitting diode) read-out of the remaining power supply in the battery 54.

Means to activate the motor 50 include a power switch 64 conventionally mounted to one of the reel support walls 18, and a remote sensor 56. The power switch 64 is in electronic communication with wiring to the battery 54 and to the motor 50 to energize the motor 50. The remote sensor 56 is conventionally connected to the battery 54 and the motor 50 to energize the motor 50, and is in communication with a remote transmitter 68. The structure of suitable remote transmitters are well known in the prior art and will not be described here.

A water inlet port or in-tube 72 is mounted through a plate 70 at about the axis of rotation of the reel 26. A water outlet port or out-tube 74 is disposed on the reel 26. The inlet port 72 is connected to an outlet port or out-tube 74 in an arrangement which will be recognized by those skilled in the art. The inlet port 72 remains fixed while the outlet port 74 rotates with the reel 26. In this configuration, the inlet port 72 and outlet port 74 remain in fluid communication with one another. This arrangement permits rotating the reel 26 without twisting or torquing internal components, while maintaining sealed fluid communication between the water supply and the hose.

In use, hose from the reel 26 is let out by hand. Once finished, instead of having to manually crank the reel 26 the user turns on the power switch 64 to turn on the motor 50 causing the rotation of the motor shaft 52 and thus the reel 26. Alternatively, the motor 50 can be energized by use of the remote 68 to communicate with the remote sensor 56 to energize the motor 50. The hose leader/guide assembly 30 moves through action of the gears 28,48. That is, when the reel gear 28 is rotated by the motor 50 rotating the reel 26, the reel gear 28 causes the assembly gear 48 to rotate. The threaded rod 32 in turn rotates. The guide assembly 30 moves along the threaded rod 32 and support rod 44 and takes up the hose guiding the hose about the reel 26.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A powered hose reel device, comprising in combination:

a frame having a back section and a support section, the back section being configured to mount the device to a wall, and the support section having a pair of poles and a bar, each pole having a first end and a second end, and each pole being mounted to the bar at the second ends, and each pole being oriented parallel to the other pole, and depending upwardly from the rod;

a pair of reel support panels having an outer surface and an inner surface, and depending from the frame, whereby the support section is secured to one of the reel support panels;

a support rim integrally formed on the inner surface of one of the support panels;

a reel having an inner surface and an outer surface, a first end and a second end, having an open chamber defined by the inner surface, and being mounted on the support rim;

a motor mounted to the inner surface of one of the reel support panels, and disposed within the open chamber of the reel;

a motor shaft having a first end and a second end, the first end being operatively connected to the motor;

a bracket mounted to the inner surface of the reel and having an aperture configured to engage with the second end of the motor shaft;

a battery as a power source for the motor;

means to activate the motor;

a hose leader/guide assembly having a threaded rod having a first end and a second end, with an outer surface, the ends being disposed through the reel support panels, a support rod having a first end and a second end, the ends of the support rod being disposed through the reel support panels, a guide member movably mounted about the threaded rod and the support rod and being movable therealong, and an assembly gear integrally formed on the outer surface of the threaded rod at the second end and positioned between the guide member and the reel support panel;

a reel gear integrally formed on the outer surface of the reel juxtaposed the second end of the reel, whereby the reel gear is configured to engage with the assembly gear; and a solar panel mounted on the first ends of the poles of the support section of the frame.

2. The powered hose reel device of claim 1, wherein the means to activate the motor is a power switch.

3. The powered hose reel device of claim 1, wherein the means to activate the motor comprises a remote sensor connected to the battery and a remote transmitter.

4. The powered hose reel device of claim 3, further comprising a battery status display mounted on one of the reel support panels.

5. The powered hose reel device of claim 4, further comprising a water inlet port and a water outlet port in fluid communication with one another.

6. The powered hose reel device of claim 1, further comprising a reel gear integrally formed on the outer surface of the reel juxtaposed the second end of the reel;

and wherein the hose leader/guide assembly comprises a threaded rod having a first end and a second end, with an outer surface, the ends being disposed through the reel support panels, a support rod having a first end and a second end, the ends of the support rod being disposed through the reel support panels, a guide member movably mounted about the threaded rod and the support rod and being movable therealong, and an assembly gear integrally formed on the outer surface of the threaded rod at the second end and positioned between the guide member and the reel support panel.

* * * * *